US011476620B2

(12) United States Patent
Zhu

(10) Patent No.: US 11,476,620 B2
(45) Date of Patent: Oct. 18, 2022

(54) ELECTRIC CONNECTOR AND LOCKING METHOD

(71) Applicant: Xiaoping Zhu, Dongguan (CN)

(72) Inventor: Xiaoping Zhu, Dongguan (CN)

( * ) Notice: Subject to any disclaimer, the term of this patent is extended or adjusted under 35 U.S.C. 154(b) by 0 days.

(21) Appl. No.: 17/197,077

(22) Filed: Mar. 10, 2021

(65) Prior Publication Data

US 2021/0203103 A1 Jul. 1, 2021

(51) Int. Cl.

| | |
|---|---|
| ***H01R 13/639*** | (2006.01) |
| ***H01R 43/26*** | (2006.01) |
| ***H01R 13/629*** | (2006.01) |
| ***H01R 13/502*** | (2006.01) |
| ***H01R 24/28*** | (2011.01) |
| ***H01R 24/76*** | (2011.01) |

(52) U.S. Cl.

CPC ..... *H01R 13/639* (2013.01); *H01R 13/502* (2013.01); *H01R 13/629* (2013.01); *H01R 43/26* (2013.01); *H01R 24/28* (2013.01); *H01R 24/76* (2013.01)

(58) Field of Classification Search

CPC .. H01R 13/627; H01R 13/639; H01R 13/629; H01R 13/502; H01R 43/26; H01R 24/28; H01R 24/76

USPC ..... 439/350

See application file for complete search history.

(56) References Cited

U.S. PATENT DOCUMENTS

| | | | | |
|---|---|---|---|---|
| 4,493,520 A * | 1/1985 | Davies | H01R 13/6276 | 439/350 |
| 5,176,533 A * | 1/1993 | Sakurai | H01R 13/6277 | 439/350 |
| 5,195,905 A * | 3/1993 | Pesci | G02B 6/389 | 439/352 |
| 2004/0014350 A1* | 1/2004 | McMullen | H01R 24/40 | 439/350 |
| 2007/0020973 A1* | 1/2007 | Sattele | H01R 13/627 | 439/101 |

* cited by examiner

*Primary Examiner* — Gary F Paumen

(57) ABSTRACT

The present disclosure provides an electric connector, which is used for being electrically connected with another adaptive connector (socket). The electric connector comprises a first shell, a lock plate, a second shell and an actuating assembly, wherein at least one electric connection point capable of being connected with the other connector is accommodated in the first shell; the lock plate is relatively fixed with the first shell; the second shell is at least partially located on the outer side of the lock plate and can move between a first position and a second position, the part of the second shell deforms the lock plate towards the inner side, so that the lock plate is tightly pressed with the outer surface of an outer shell of the other connector for frictional locking. According to the electric connector, the locking and pressing frictional force between the electric connectors can be improved.

13 Claims, 6 Drawing Sheets

ELECTRIC CONNECTOR AND LOCKING METHOD

TECHNICAL FIELD

The present disclosure relates to the technical field of connectors, in, particular to an electric connector and a locking method.

BACKGROUND

Connectors are relatively wide in application fields and can generally comprise plugs and sockets. The plug is used as a male head, plug pins are arranged on the plug, the socket is used as a female head, contact pins are arranged in the socket, and the plug pins can be inserted into the socket to be electrically contacted with the contact pins in the socket to realize electric conduction between a power supply and electric equipment. When the plug and the socket are connected, the plug and the socket are easily separated due to external factors to cause failure of electric connection, which may cause serious consequences. In order to prevent the failure of electric connection between the electric connectors, a locking structure is arranged on the electric connector, and the tab on the locking structure moves to be inserted into the middle of outer shells of the two electric connectors mutually inserted for frictional locking. The locking force of the locking structure is not enough, and the two electric connectors are still easy to loosen, and there are risks.

SUMMARY

In view of this, in order to solve one of the technical problems in the related technology to a certain extent, it is necessary to provide an electric connector and a locking method, so that the locking frictional force between the electric connectors is improved, the locking effect is enhanced, and the two electric connectors are not easy to loosen during locking.

The present disclosure provides an electric connector, used for being electrically connected with an other adaptive connector, comprising:

a first shell, in which at least one electric connection point capable of being connected with the other connector being accommodated;

a lock plate, which is relatively fixed with the first shell;

a second shell, which is at least partially located on the outer side of the lock plate and can slide relative to the first shell so as to be located at a first position or a second position relative to the first shell, wherein when the second shell is located at the first position, the part, located on the outer side of the lock plate, of the second shell deforms the lock plate towards the inner side so that the lock plate is tightly pressed with the outer surface of an outer shell of the other connector for frictional locking, and when the second shell is located at the second position, the lock plate is not frictionally locked with the outer surface of the outer shell of the other connector so that the electric connector can be separated from the other connector; and an actuating assembly, which is used for enabling the second shell to slide relative to the first shell so as to be located at the first position or the second position relative to the first shell.

The present disclosure also provides a locking method of an electric connector, the electric connector being used for being electrically connected with an other adaptive connector, the locking method comprising the following steps:

providing a first shell and accommodating at least one electric connection point capable of being electrically connected with the other connector in the first shell;

providing a lock plate so that the lock plate is relatively fixed with the first shell;

providing a second shell, which is at least partially located on the outer side of the lock plate and can slide relative to the first shell; and providing an actuating assembly, which is used for enabling the second shell to slide relative to the first shell so that the second shell is located at a first position or a second position relative to the first shell, wherein when the second shell is located at the first position, the part, located on the outer side of the lock plate, of the second shell deforms the lock plate towards the inner side so that the lock plate is frictionally locked with the outer surface of an outer shell of the other connector, and when the second shell is located at the second position, the lock plate is not frictionally locked with the outer surface of the outer shell of the other connector so that the electric connector can be separated from the other connector.

According to the scheme, the second shell arranged on the outer side of the lock plate serves as a driving part, the lock plate is static relative to the first shell, only resistance exists between the inner side face of the second shell and the lock plate in the running process of the second shell, and therefore, the second shell can move towards the direction of the second position more smoothly in the running process to deform the lock plate; the lock plate is directly pressed on the surface of the outer shell of the other connector for frictional locking, so that the lock plate can be pressed on the surface of the outer shell, of the other connector by the second shell with larger pressure during structural design, the locking effect is enhanced, and the two electric connectors are not easy to loosen during locking.

The present disclosure will be further described with reference to the attached figures in the following specific embodiments.

DETAILED DESCRIPTION

The following clearly and completely describes the technical scheme in the embodiments of the present disclosure with reference to the attached figures in the embodiments of the present disclosure. Apparently, the described embodiments are merely a part rather than all of the embodiments of the present disclosure. All other embodiments obtained by those skilled in the art based, on the embodiments of the present disclosure without creative efforts shall fall within the protection scope of the present disclosure. It can be understood that the attached figures are for reference and illustration purposes only and are not intended to limit the present disclosure. The connection relationships shown in the attached figures are merely for ease of clear description and do not limit the manner of connection.

Figure 1:
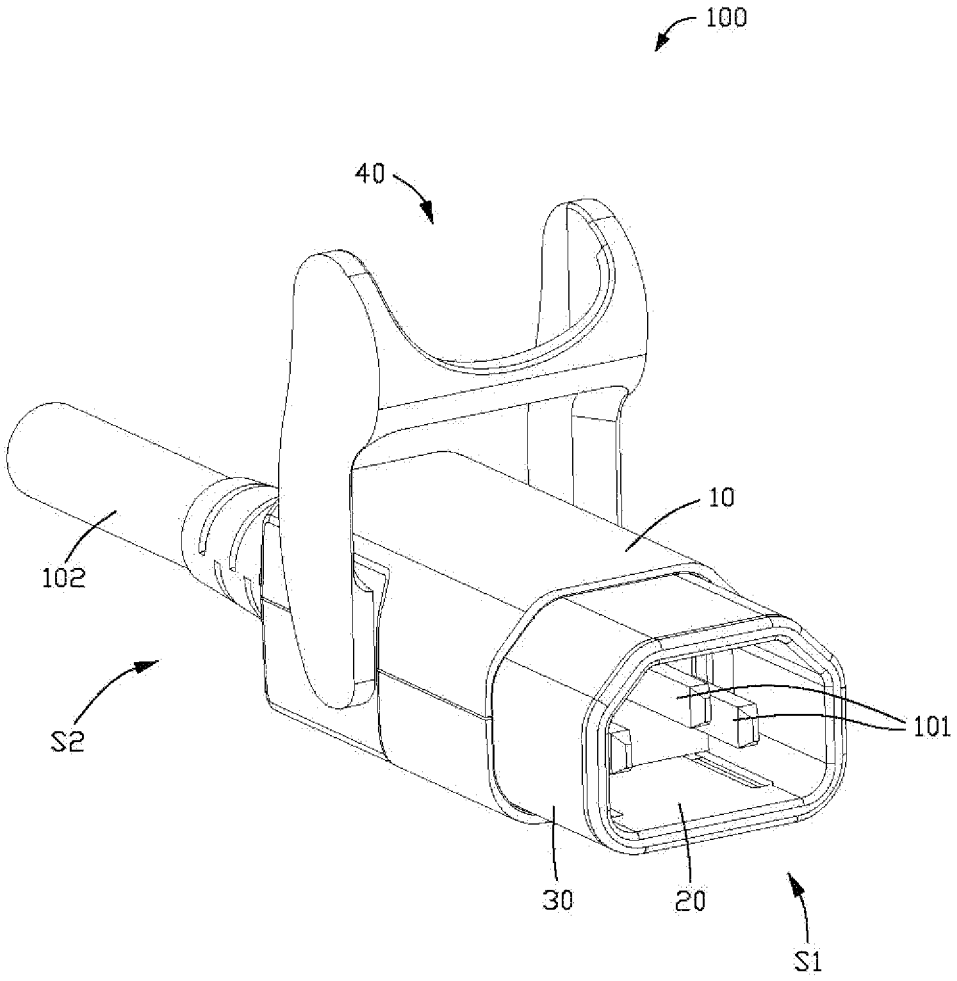
FIG. 1 is a structural schematic diagram of a specific embodiment in the present disclosure.

FIG. 1 illustrates a structural schematic diagram of an electric connector 100 in an embodiment of the present disclosure. As shown in FIG. 1, the electrical connector 100 in FIG. 1 is a male plug which can be connected to an other connector (female plug) 200 to achieve electric conduction. The other connector 200 is provided with an outer shell 210 (shown in FIG. 3) 210, pins (not shown) are arranged in the outer shell 210, and plug pins 101 on the electric connector 100 are inserted into the outer shell 210 and electrically connected with the pins. Wherein, the electric connector 100 may also be a female socket, while the adaptive connector 200 is connected as a male plug.

The electric connector 100 is provided with a front end S1 and a rear end S2. The plug pins 101 are arranged at the front end S1, the front end S1 serves as an inserted end, and the rear end S2 is provided with a power line 102 electrically connected with the plug pins 101.

Figure 2:
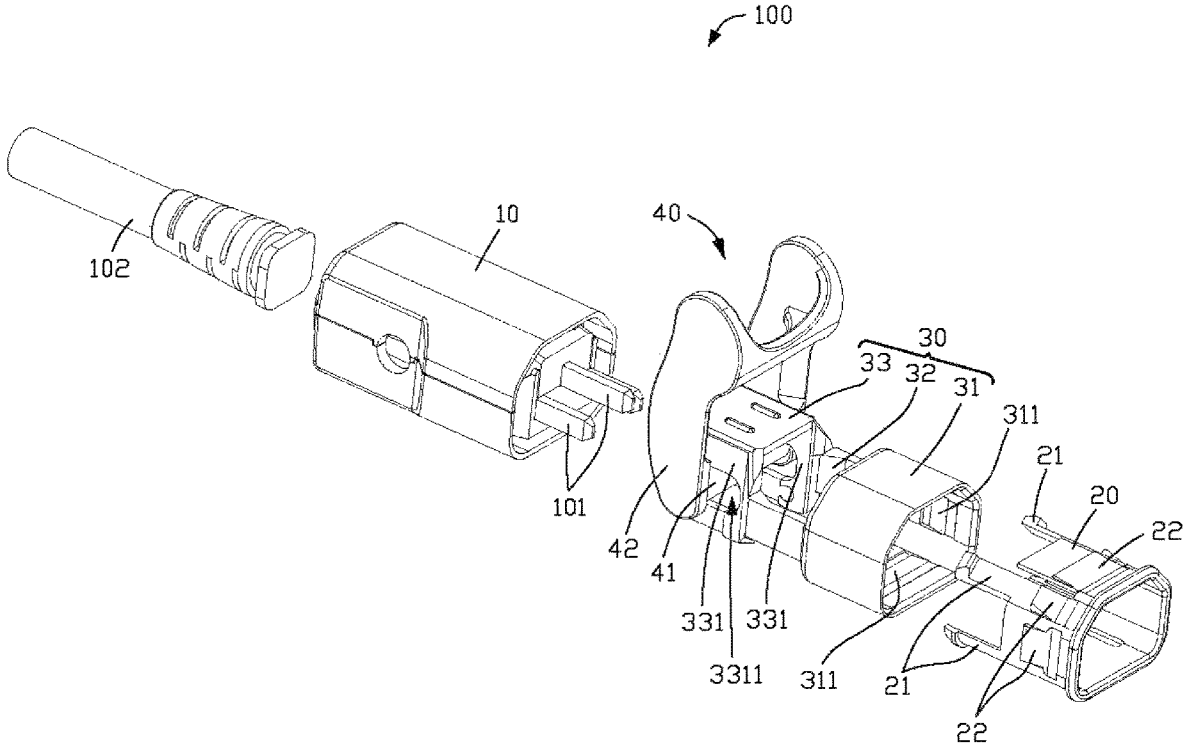
FIG. 2 is an explosive view of FIG. 1.

Referring to FIG. 2 concurrently, the electric connector 100 comprises a first shell 10, a lock plate 20, a second shell 30 and an actuating assembly 40. The lock plate 20 is arranged at the front end S1 of the first shell 10, and the plug pins 101 extend out of the surface of the front end S1 of the first shell 10 and are arranged on the inner side of the lock plate 20. The lock, plate 20 is relatively fixed with the first shell 10, clamping hooks 21 can be formed on the lock plate 20 towards the rear end S2, and the lock plate 20 is fixed to the first shell 10 through the clamping hooks 21. It can be understood that the lock plate 20 further can be integrally formed with the first shell 10. The lock plate 20 may be relatively thin in thickness and may be made of a material which is more easily deformable.

Figure 3:
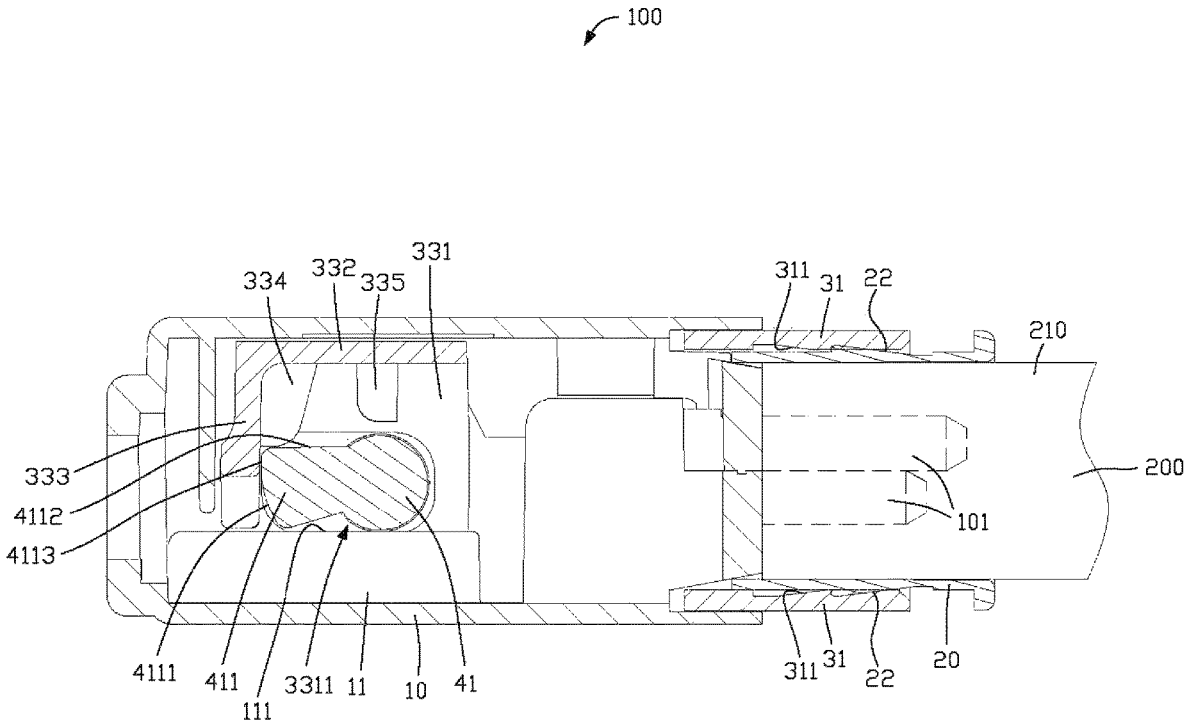
FIG. 3 is a section view of a specific embodiment when a second shell is located at a first position in the present disclosure.
Figure 4:
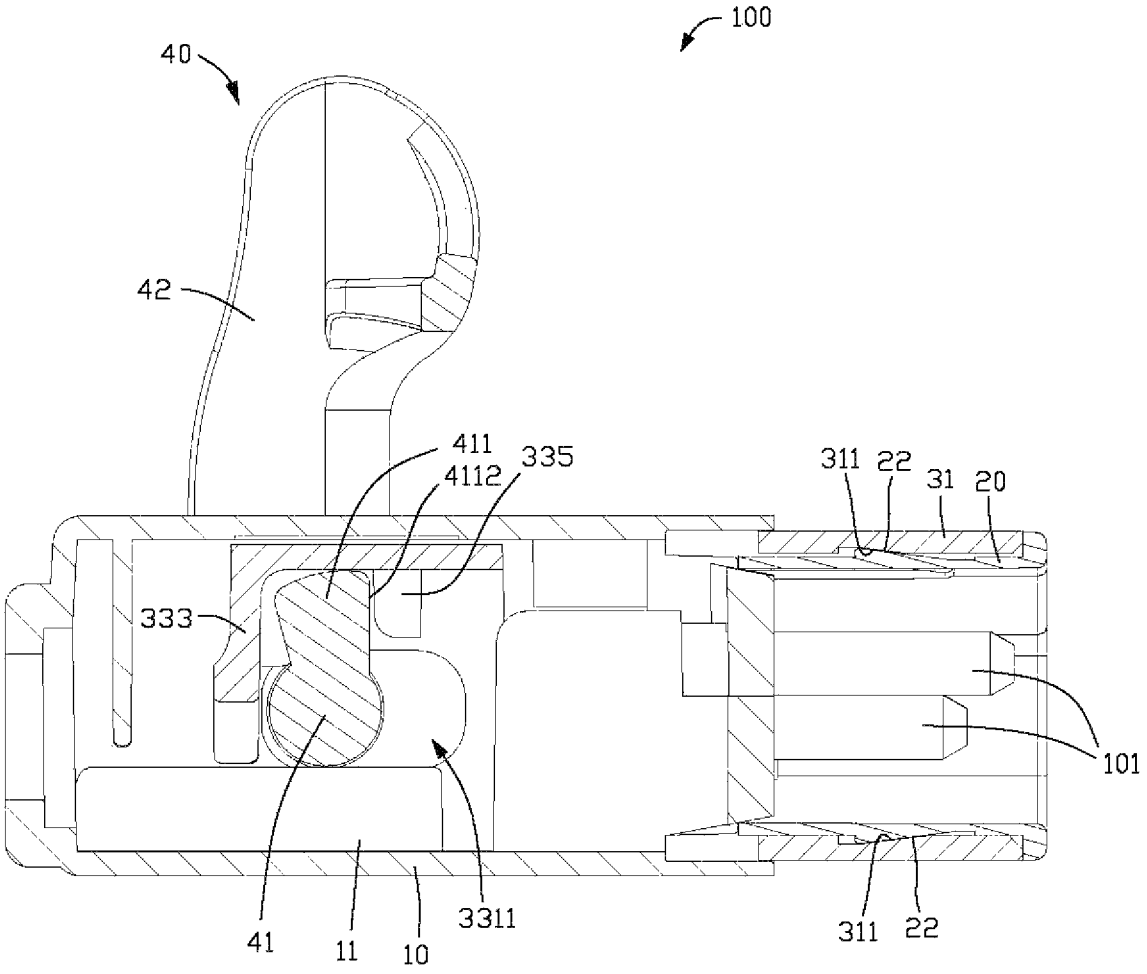
FIG. 4 is a section view of a specific embodiment when the second shell is located at a second position in the present disclosure.

Referring to FIG. 3 and FIG. 4 concurrently, the second shell 30 is in sliding connection with the first shell 10 and is movable relative to the first shell 10 between a first position (position shown in FIG. 3) and a second position (position shown in FIG. 4). The second shell 30 may comprise a front end part 31, a connecting part 32, and a rear end part 33, and the front end part 31 is connected to the rear end part 33 through the connecting part 32. The front end part 31 is located on the outer side of the lock plate 20 and used for being matched with the lock plate 20, and the connecting part 32 and the rear end part 33 are arranged in the first shell 10 to be hidden.

The actuating assembly 40 is mounted through the first shell 10, the rear end part 33 of the second shell 30 is matched with the actuating assembly 40, the second shell 30 slides relative to the first shell 10 by operating the actuating assembly 40 so that the second shell 30 moves between the first position and the second position, the first position is on the rear side of the second position.

Referring to FIG. 3, when the second shell 30 is located at the first position, the front end part 31 deforms the lock plate 20 toward the inner side, the pressure between the lock plate 20 and the surface of the outer shell 210 of the other connector 200 is increased, and the lock plate 20 is tightly pressed with the other connector 200 for frictional locking. Referring to FIG. 4, when the second shell 30 is located at the second position, the pressure of the front end part 31 acting on the lock plate 20 is decreased, the pressure between the lock plate 20 and, the surface of the outer shell 210 of the other connector 200 is decreased or repealed, and at the moment, the electric connector can be pulled out of the other connector 200, so that the two electric connectors can be separated.

The second shell 30 arranged on the outer side of the lock plate 20 serves as a driving part, the lock plate 20 is static relative to the first shell 10, only resistance exists between the inner side face of the second shell and the lock plate 20 in the running process of the second shell 30, and therefore, the second shell 30 can move towards the direction of the first position more smoothly in the running process to deform the lock plate 20; the lock plate 20 is directly pressed on the surface of the outer shell 210 of the other connector 200 for frictional locking, so that the lock plate 20 can be pressed on the surface of the outer shell 210 of the other connector 200 by the second shell 30 with larger pressure during structural design, the locking effect is enhanced, and the two electric connectors 100 and 200 are not easy to loosen during locking.

In the embodiment, the front end part 31 and the lock plate 20 are each configured in a ring shape that forms an accommodating cavity which may be matched with the shape of the outer shell 210 of the other connector 200 and is formed by accommodating the outer shell 210 of the other connector 200 in the inner side of the lock plate 20. The front end part 31 is configured to be an annular shell part, so that the front end part 31 is not easy to deform outwards when the lock plate 20 is extruded, extrusion of the front end part 31 to the lock plate 20 is enhanced, and the locking force of the lock plate 20 is improved. A first slope 311 is arranged on the inner side face of the annular shell part 31, a second slope 22 is arranged on the lock plate 20, the inclination direction of the first slope 311 is the same as that of the second slope 22, and the first slope 311 moves relative to the second slope 22 to deform the lock plate 20 towards the inner side. The lock plate 20 is annularly provided with a plurality of positions (slopes 22) matched with the front end part 31, the positions can be extruded by the front end part 31 at the same time to deform towards the inner side, the lock plate 20 and the other connector 200 achieve multi-position pressing friction locking, and the locking force of the lock plate 20 is further enhanced.

Figure 5:
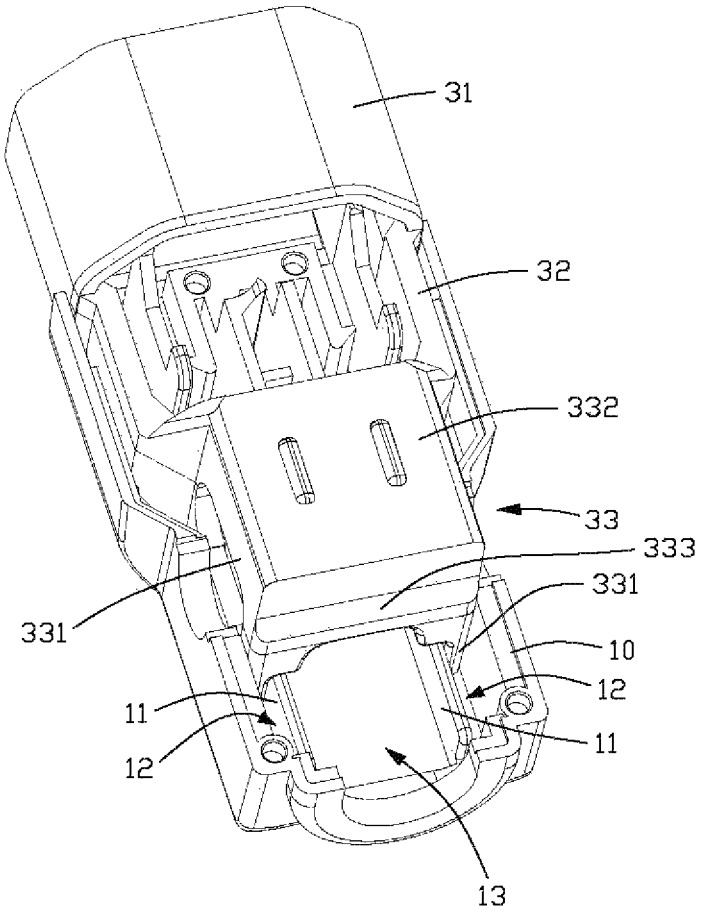
FIG. 5 is an internal schematic diagram of a first shell in a specific embodiment of the present disclosure.
Figure 6:
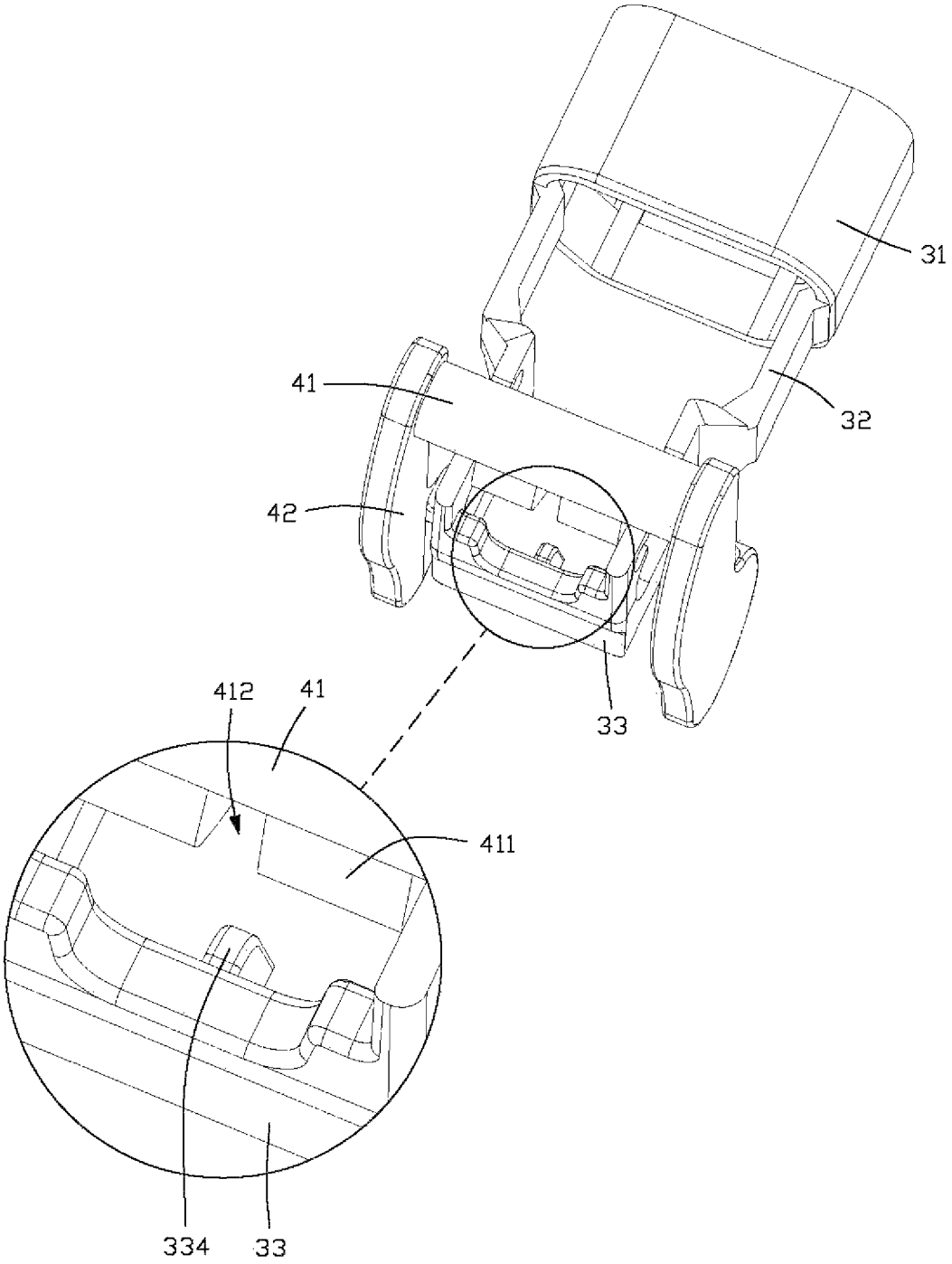
FIG. 6 is a structural schematic diagram that an actuating assembly is matched with the second shell in a specific embodiment of the present disclosure.

Referring to FIG. 2 and referring to FIG. 3 and FIG. 4 concurrently, the rear end part 33 comprises two sides plate 331 and a top plate 332 connecting the two side plates 331. Referring to FIG. 5 concurrently, two spaced vertical plates 11 are formed on the inner bottom face of the first shell 10, the vertical plates 11 extend in the front-back direction and form sliding grooves 12 with the first shell 10, the two side plates 331 of the rear end part 33 are arranged in the two sliding grooves 12 respectively, and when the second shell 30 slides relative to the first shell 10, the side plates 331 slide in the sliding grooves 12. A groove body 13 for accommodating a wire connected with the plug pins 101 is formed between the two vertical plates 11.

In a specific embodiment, the actuating assembly 40 comprises a rotating 41 and handles 42, and the handles 42 may be integrally formed with the rotating shaft 41 directly. The rotating shaft 41 is rotationally connected to the first shell 10 and transversely arranged in the left-right direction, kidney-shaped holes 3311 for the rotating shaft 41 to penetrate through are formed in the two side plates 331, the kidney-shaped holes 3311 extend in the front-back direction, and when the second shell 30 slides front and hack relative to the first shell 10, the rotating shaft 41 is located in the kidney-shaped holes 3311 and slides relative to the rotating shaft 41. The handles 42 are connected to the two ends of the outer side of the rotating shaft 41, and the rotating shaft 41 can be driven to rotate by rotating the handles 42.

An actuating structure 411 is formed on the rotating shaft 41, when the rotating shaft 41 rotates to a first angle, the second shell 30 is located at the first position through the actuating structure 411, and when the rotating shaft 41 rotates to a second angle, the second shell 30 can move to the second position. In a specific embodiment, the actuating structure 411 may be a convex block arranged on the rotating shaft 41, and of course, the actuating structure 411 may also be a slope structure matched with the convex, block arranged on the second shell 30.

It should be noted that the radial distance between the convex block 411 and the axis of the rotating shaft 41 is smaller than the radial distances between the handles 42 and the axis of the rotating shaft 41, the handles 42, the rotating shaft 41 and the convex block 411 form a lever structure, and a user can enable the convex block 411 to stir the second shell 30 to slide between the first position and the second position with little force, and the user can easily and conveniently lock or unlock the two connectors 100 and 200 whether the two connectors 100 and 200 are locked or unlocked.

A lock groove 412 is formed in the rotating shaft 41, a lock plate 334 (in the figure, the lock plate 334 being arranged on the rear end part 33) is arranged on the first shell 10 or the rear end part 33, and when the rotating shaft 41 rotates to the first angle, the lock plate 334 is clamped in the lock groove 412, so that the lock plate 334 cannot be separated from the lock groove 412, namely the rotating shaft 41 cannot rotate, under the conditions that the rotating shaft 41 is clamped and the handles 42 apply small external force; and the second shell 30 is stably kept at the first position. In a specific embodiment, the lock groove 412 is radially formed in the convex block 411.

The convex block 411 is provided with a first surface 4111, a second surface 4112 and a third surface 4113. The first surface 4111 is generally an arc-shaped surface, along with the rotation of the convex block 411 towards the direction of the first angle (counterclockwise direction shown in FIG. 3), a different position of the first surface 4111 acts on a rear plate 333 of the second shell 30 so that the second shell 30 slides towards the direction of the first position. A baffle plate 335 is formed on the top plate 332 of the rear end part 33, along with the rotation of the convex block 411 towards the direction of the second angle (clockwise direction shown in FIG. 3), the second surface 4112 makes contact with the baffle plate 335, and therefore, the convex block 411 drives the second shell 30 to slide towards the direction of the second position.

The third surface 4113 is located between the first surface 4111 and the second surface 4112, the third surface 4113 is preferably planar, along with the rotation of the convex block 411 towards the direction of the first angle, when the second shell reaches the first position, the third surface 4113 makes contact with the second shell 30 so that the second shell 30 keeps at the first position, and the second shell 30 is stably kept at the first position.

The top faces 111 of the vertical plates 11 are used for being matched with the convex block 411, and when the rotating shaft 41 rotates from the second angle to the first angle, the vertical plates 11 prevent the rotating shaft 41 from crossing the first angle.

The specific embodiment of the present disclosure also provides a locking method of an electric connector, the locking method comprising the following steps:

S110, providing a first shell 10 and accommodating at least one electric connection point 101 capable of being electrically connected with the other connector 200 in the first shell;

S120, providing a lock plate 20 so that the lock plate is relatively fixed with the first shell 10;

S130, providing a second shell 30, which is at least partially located on the outer side of the lock plate 20 and can slide relative to the first shell 10; and S140, providing an actuating assembly 40, which is used for enabling the second shell 30 to slide relative to the first shell 10 so that the second shell 30 is located at a first position or a second position relative to the first shell 10, wherein when the second shell 30 is located at the first position, the part, located on the outer side of the lock plate 20, of the second shell 30 deforms the lock plate 20 towards the inner side so that the lock plate 20 is tightly pressed with the outer surface of an outer shell 210 of the other connector 200 for frictional locking, and when the second shell 30 is located at the second position, the lock plate 20 is not tightly pressed with the outer surface of the outer shell 210 of the other connector 200 for frictional locking so that the electric connector can be separated from the other connector 200.

The foregoing descriptions are merely exemplary embodiments of the present disclosure, but are not intended to limit the present disclosure. Any modification, equivalent replacement, or improvement made within the spirit and principle of the present disclosure shall fall within the protection scope of the present disclosure.

What is claimed is:

1. An electric connector, used for being electrically connected with an other adaptive connector, comprising:

a first shell, in which at least one electric connection point capable of being connected with the other connector being accommodated;

a lock plate, which is relatively fixed with the first shell;

a second shell, which is at least partially located on the outer side of the lock plate and can slide relative to the first shell so as to be located at a first position or a second position relative to the first shell, wherein when the second shell is located at the first position, a part, located on the outer side of the lock plate, of the second shell deforms the lock plate towards the inner side so that the lock plate is tightly pressed with the outer surface of an outer shell of the other connector for frictional locking, and when the second shell is located at the second position, the lock plate is not tightly pressed with the outer surface of the outer shell of the other connector for frictional locking so that the electric connector can be separated from the other connector; and an actuating assembly, which is used for enabling the second shell to slide relative to the first shell so as to be located at the first position or the second position relative to the first shell, wherein the actuating assembly comprises a rotating shaft and handles, the handles are connected with the rotating shaft so as to drive the rotating shaft to rotate through the handles, an actuating structure is formed on the rotating shaft, and when the rotating shaft rotates to a first angle, the second shell is located at the first position through the actuating structure.

2. The electric connector according to claim 1, wherein a lock groove is formed in the rotating shaft, the lock plate is arranged on the first shell or the second shell, and when the rotating shaft rotates to the first angle, the lock plate is clamped in the lock groove.

3. The electric connector according to claim 2, wherein the actuating structure is a convex block arranged on the rotating shaft.

4. The electric connector according to claim 3, wherein the lock groove is radially formed in the convex block.

5. The electric connector according to claim 3, wherein the convex block is provided with a first surface, the first surface acts on the second shell so that the second shell slides towards the direction of the first position, the convex block is provided with a second surface, and the second surface acts on the second shell so that the second shell slides towards the direction of the second position.

6. The electric connector according to claim 5, wherein the convex block is provided with a third surface, and the third surface is used for making contact with the second shell so that the second shell keeps at the first position.

7. The electric connector according claim 5, wherein a sliding groove is formed each shell, the second shell is at least partially arranged in the corresponding sliding groove, a wire connected with the electric connection point is arranged between the side walls of the sliding grooves, and the top faces of the side walls of the sliding grooves are used for being matched with the convex block so as to prevent the rotating shaft from crossing the first angle.

8. The electric connector according to claim 1, wherein the lock groove is arranged on the rotating shaft, the lock groove is formed in the second shell, and when the rotating shaft rotates to the first angle, the lock plate is clamped in the lock groove.

9. The electric connector according to claim 1, wherein the second shell comprises an annular shell part matched with the lock plate.

10. The electric connector according to claim 9, wherein a first slope is arranged on the inner side face of the annular shell part, a second slope is arranged on the lock plate, and the first slope moves relative to the second slope so that the lock plate deforms towards the inner side.

11. The electric connector according to claim 9, wherein the lock plate is ring-shaped, the inner side of the lock plate forms an accommodating cavity of the outer shell of the other connector, and when the second shell is located at the first position, the second shell deforms multiple circular positions of the lock plate towards the inner side.

12. The electric connector according to claim 1, wherein clamping hooks are formed on the lock plate, and the lock plate is connected to the first shell through the clamping hooks.

13. A locking method of an electric connector, the electric connector being used for being electrically connected with an other adaptive connector, the locking method comprising the following steps:

providing a first shell and accommodating at least one electric connection point capable of being electrically connected with the other connector in the first shell;

providing a lock plate so that the lock plate is relatively fixed with the first shell;

providing a second shell, which is at least partially located on the outer side of the lock plate and can slide relative to the first shell; and providing an actuating assembly, which is used for enabling the second shell to slide relative to the first shell so that the second shell is located at a first position or a second position relative to the first shell, wherein when the second shell is located at the first position, a part, located on the outer side of the lock plate, of the second shell deforms the lock plate towards the inner side so that the lock plate is frictionally locked with the outer surface of an outer shell of the other connector, and when the second shell is located at the second position, the lock plate is not frictionally locked with the outer surface of the outer shell of the other connector so that the electric connector can be separated from the other connector, wherein the actuating assembly comprises a rotating shaft and handles, the handles are connected with the rotating shaft so as to drive the rotating shaft to rotate through the handles, an actuating structure is formed on the rotating shaft, and when the rotating shaft rotates to a first angle, the second shell is located at the first position through the actuating structure.

* * * * *